US009723869B2

(12) United States Patent
Selby

(10) Patent No.: US 9,723,869 B2
(45) Date of Patent: Aug. 8, 2017

(54) SMOKING APPARATUS

(71) Applicant: Ryan Daniel Selby, Vancouver (CA)

(72) Inventor: Ryan Daniel Selby, Vancouver (CA)

(73) Assignee: Ryan Daniel Selby, Vancouver, BC (CA)

( * ) Notice: Subject to any disclaimer, the term of this patent is extended or adjusted under 35 U.S.C. 154(b) by 535 days.

(21) Appl. No.: 14/088,238

(22) Filed: Nov. 22, 2013

(65) Prior Publication Data

US 2015/0144146 A1 May 28, 2015

(51) Int. Cl.
*A24F 1/28* (2006.01)

(52) U.S. Cl.
CPC ..... *A24F 1/28* (2013.01)

(58) Field of Classification Search
USPC ..... 131/222, 225, 226, 230, 328–330, 182
See application file for complete search history.

(56) References Cited

U.S. PATENT DOCUMENTS 1,907,338 A * 5/1933 Hirsch ..... A24F 13/10 131/182
2,546,237 A * 3/1951 Rehfeld ..... A24F 1/28 131/182
2,870,771 A * 1/1959 Gossler ..... A24F 13/12 131/178
3,294,098 A * 12/1966 Gustafson ..... A24F 13/04 131/184.1
3,685,520 A * 8/1972 Chernack ..... A24F 13/06 131/182
3,750,677 A * 8/1973 Jodoin ..... A24F 5/00 131/181
3,805,808 A * 4/1974 Yoshinaga ..... A24F 13/10 131/182

* cited by examiner

*Primary Examiner* — Dennis Cordray
(74) *Attorney, Agent, or Firm* — Banner & Witcoff, Ltd.

(57) ABSTRACT

An example smoking apparatus for use with smoking materials in accordance with aspects of the present disclosure includes a mouthpiece, a bowl piece, and an inner tube, connecting the mouthpiece and the bowl piece. The smoking apparatus comprises an ejection mechanism to eject used smoking materials.

16 Claims, 7 Drawing Sheets

SMOKING APPARATUS

BACKGROUND

A smoking apparatus, which may be called pipe, may be specifically made to smoke tobacco. Smoking systems including pipes may be used to hold tobacco for smoking instead of rolling a cigarette or purchasing ready-made cigarettes. A pipe may have a chamber (a bowl) for the tobacco from which a thin hollow stem emerges, ending in a mouthpiece. A pipe may need to extinguish itself after every single puff.

A pipe may range from very simple machine-made briar models to highly-prized hand-made artisanal implements made by renowned pipemakers.

BRIEF DESCRIPTION OF THE DRAWINGS

Example implementations are described in the following detailed description and in reference to the drawings, in which.

DETAILED DESCRIPTION

Various implementations described herein are directed to a smoking apparatus. More specifically, and as described in greater detail below, various aspects of the present disclosure are directed to a manner by which a smoking apparatus allows a user to easily eject residue (e.g., ash) from the smoking apparatus.

Aspects of the present disclosure described herein implement a smoking apparatus with various engagements and disengagements of the body and the inner component. Moreover, aspects of the present disclosure described herein also disclose the multi-piece form allowing ashes and smoking material to be expelled from the smoking apparatus without requiring additional tools. According to various aspects of the present disclosure, the approach described herein makes operation of the smoking apparatus by the user less messy, and more simple and convenient. Among other things, this approach described herein allows for conveniently operating the smoking apparatus. This also advantageously provides improves smoking quality and tobacco usage.

In one example in accordance with the present disclosure, a smoking apparatus is provided. The smoking apparatus comprises a mouthpiece, a bowl piece, and an inner tube, connecting the mouthpiece and the bowl piece. The smoking apparatus comprises an ejection mechanism to eject used smoking materials.

In another example in accordance with the present disclosure, a method for ejecting used smoking materials out of a smoking apparatus is provided. The method comprises forcing the used smoking materials out of the smoking apparatus in response to a change in position of the inner tube in the smoking apparatus. The smoking apparatus comprises an inner tube, and the change in the position of the inner tube occurs when the inner tube is moved forward.

Figure 1:
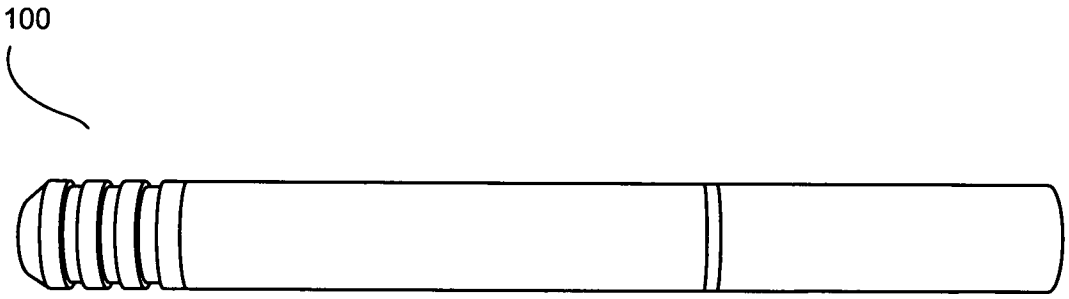
FIG. 1 illustrates an example smoking apparatus in a completely assembled operational state in accordance with the principles disclosed herein.

FIG. 1 illustrates an example smoking apparatus 100, which provides a system for a user to easily eject the ash from the smoking apparatus 100 in accordance with an implementation. It should be readily apparent that the smoking apparatus 100 depicted in FIG. 1 represents an illustration and that other components may be added or existing components may be removed, modified, or rearranged without departing from a scope of the present disclosure.

Moreover, the smoking apparatus 100 is shown to have a cylindrical shape. It should be readily apparent that the smoking apparatus 100 represents an illustration and that its shape, material, color, and other characteristics may be changed without departing from a scope of the present disclosure. Further, the smoking apparatus 100 incorporating the principals of this disclosure may be built in various sizes. For example, the dimensions may be about 3.25" in length, 0.34" in diameter at the mouth end, and 0.41" in diameter at the bowl end.

In some implementations, the smoking apparatus 100 may be made of a lightweight and heat-resistant material. The ends of the smoking apparatus may be preferably formed of a metal, such as aluminum. In this way, the user can hold the smoking apparatus in his or her fingers or mouth in the same manner as a conventional cigarette.

Figure 2:
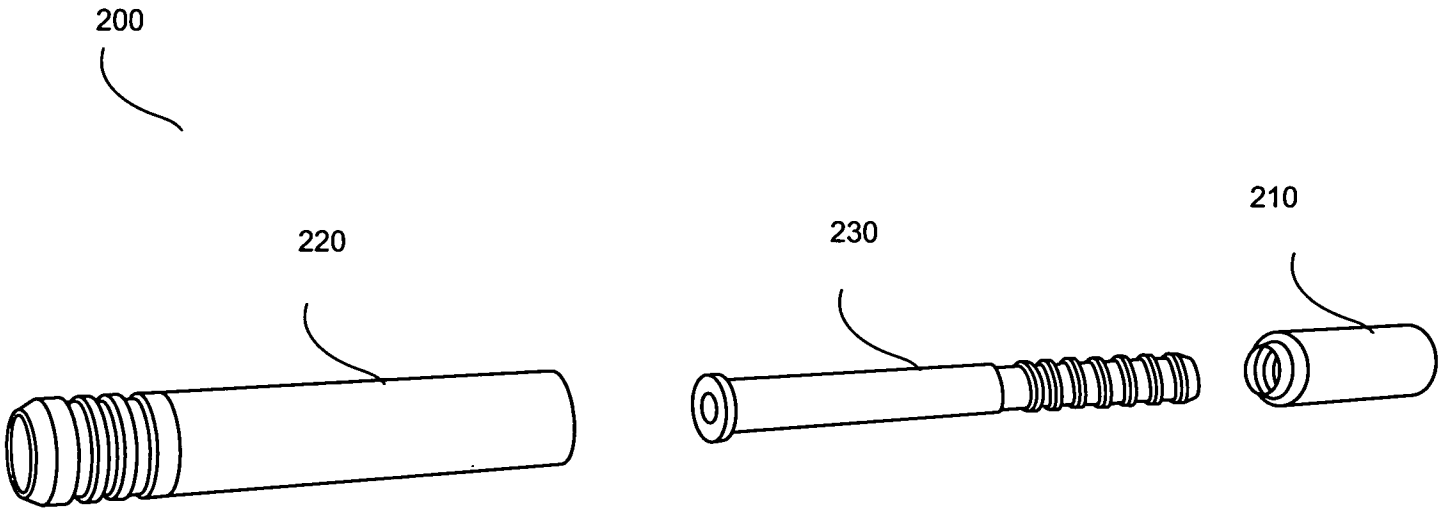
FIG. 2 illustrates an example smoking apparatus from FIG. 1 in accordance with the principles disclosed herein.

FIG. 2 illustrates an example smoking apparatus 200 in accordance with an implementation. More specifically, FIG. 2 shows the unassembled version of the smoking apparatus 100 of FIG. 1. The smoking apparatus 200 according to the present disclosure comprises a mouthpiece 210, a bowl 220, and an inner tube 230, which is described in greater detail below.

The mouthpiece 210 may comprise an air passage extending longitudinally through the smoking apparatus 200. In use, smoke from the ignited smoking material may be drawn through the resulting air passage and out the opening of the mouthpiece 210 and into the user's mouth.

The mouthpiece 210 may be connected to the bowl piece 220. The connection may be in such a manner that they can be manually separated. In some implementations, the bowl piece 220 may be made of woods such as cherry, olive, maple, mesquite, oak, and bog-wood. In other implementations, the bowl piece 220 may be made of briar wood, meerschaum, corncob or clay. In various implementations, the smoking apparatus bowls may be decorated by carving.

The inner tube 230 may join the mouthpiece 210 to the bowl piece 220, and forms the bottom of the bowl. The two pieces may be joined through screw threads. More specifically, the mouthpiece 210 may be rotated counter-clockwise while the bowl piece 220 remains stationary, and the screw threads on the inner piece 230 allow the mouthpiece to move away from the bowl piece. Moreover, the inner tube 230 may comprise an ejecting mechanism, which may be used to eject residue (e.g., ash) from the smoking apparatus. When the bowl piece 220 is unscrewed and away from the mouthpiece 210, the mouthpiece may be pushed forward. Such act results in pushing the inner tube 230 forward, which forces out the contents (e.g., ash) of the bowl piece 220. When the user desires to reassemble the separated components, the inner tube 230 threads are engaged in the cooperating the mouthpiece 210 threads. The mouthpiece 210 may them be rotated clockwise which brings the mouthpiece 210 back towards the bowl piece 220. Continued clockwise rotation of the mouthpiece 210 relative to the bowl piece 220 may cause the mouthpiece 210 to contact the bowl piece 220. More specifically, the mouthpiece 210 may be screwed towards the bowl piece 220 until the mouthpiece 210 meets the bowl piece 220, thereby securely attaching the mouthpiece 210 to the bowl piece 220. The inner tube 230 being the center piece may act as a locking mechanism when the inner tube 230, which sits in the bowl piece 220, is screwed into the mouth piece 210, and the mouthpiece 210 meets the bowl piece 220.

In alternative implementations, the smoking apparatus may have a groove with a tab in the inner tube 230 to keep the parts from endlessly spinning.

In another implementation, the screw thread between the mouthpiece 210 and the inner tube 230 is cut at such an angle to allow the loosening and tightening with virtually a single twist. For example, the screw thread may be cut at a 2.5 mm of travel per complete single rotation.

In a further implementation, a combination of aluminum and wood may be used in the smoking apparatus 200. The cuffing allows the aluminum and wood to fit together (e.g., metal used inside, wood used outside). It should be noted that a plurality of other combinations of materials may be used in the smoking apparatus 200.

Figure 3A:
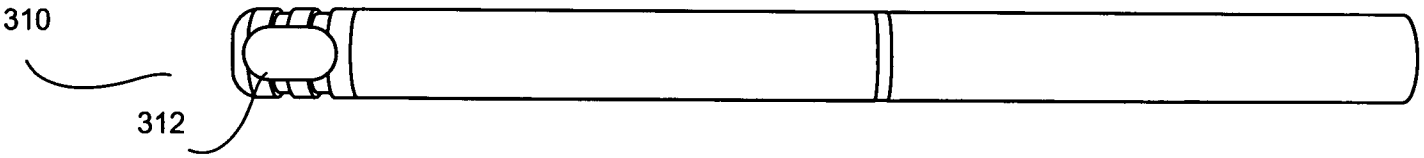
FIGS. 3A, 3B, 3C, 3D and 3E illustrate various demonstrations of steps of ejecting ash from the smoking apparatus in accordance with the principles disclosed herein.

FIGS. 3A-3E illustrate an example employment of the smoking apparatus in accordance with an implementation. Such example employment includes steps 310-350 of an example process in accordance with an implementation. In one implementation, the employment begins in response to a user initiating the process of ejecting ash from the smoking apparatus after the smoking apparatus is lit up and the tobacco is consumed. As illustrated in FIG. 3A, the process may begin, where a smoking apparatus contains ash 312 in the bowl piece of the smoking apparatus.

Figure 3B:
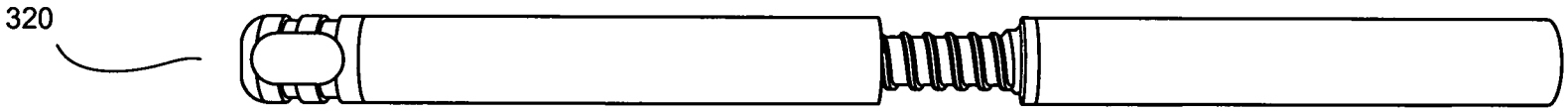

As illustrated in FIG. 3B, the user would rotate the mouthpiece of the smoking apparatus relative to the bowl piece in a counter-clockwise direction to separate the mouthpiece and the bowl piece.

Figure 3C:
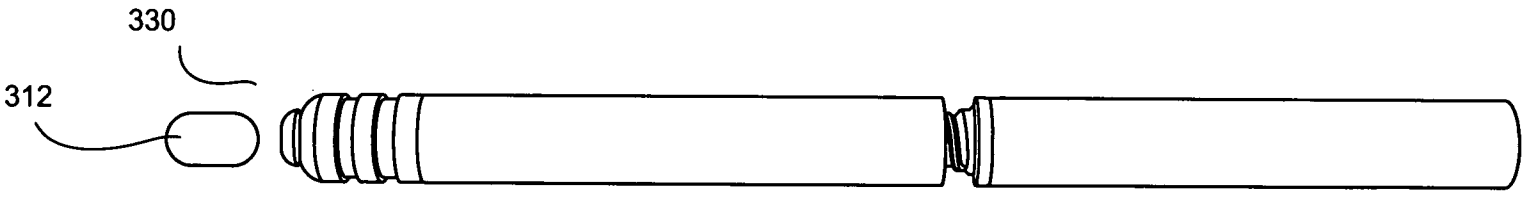

FIG. 3C illustrates the mouthpiece being pushed forward. Such act results in pushing the inner tube forward, which forces the ash 312 out of the bowl piece.

Figure 3D:
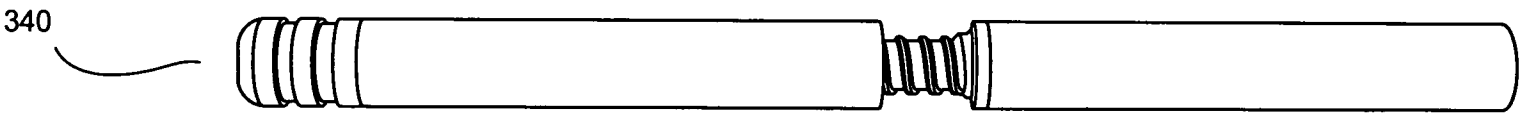

As illustrated in FIG. 3D, after the expulsion of the ash from the smoking apparatus, to reclose the smoking apparatus, the user would reattach the mouthpiece and the bowl piece by rotating the mouthpiece relative to the bowl piece in the clockwise direction, thereby engaging the cooperating threads.

Figure 3E:
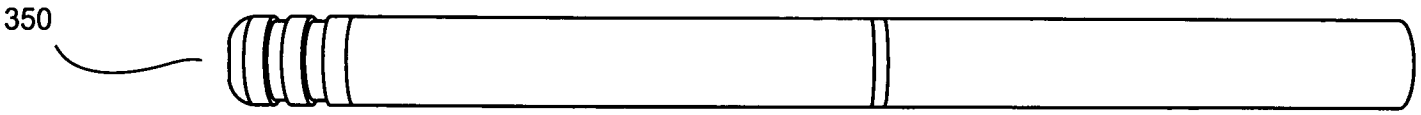

FIG. 3E illustrates that the inner tube, which sits in the bowl piece is screwed into the mouth piece, securely attaching the mouthpiece to the bowl piece.

The present disclosure has been shown and described with reference to the foregoing exemplary implementations. Although specific examples have been illustrated and described herein it is manifestly intended that the scope of the claimed subject matter be limited only by the following claims and equivalents thereof. It is to be understood, however, that other forms, details, and examples may be made without departing from the spirit and scope of the disclosure that is defined in the following claims.

What is claimed is:

1. A smoking apparatus for use with smoking materials, comprising:

a mouthpiece;

a bowl piece, and an inner tube, connecting the mouthpiece and the bowl piece, wherein the inner tube comprises screw threads configured to be screwed into cooperating threads of the mouthpiece, wherein the smoking apparatus comprises an ejection mechanism to eject used smoking materials, and wherein the ejection mechanism is activated when the mouthpiece is rotated allowing the screw threads of the inner tube to move the bowl piece away from the mouthpiece.

2. The smoking apparatus of claim 1, wherein the mouthpiece and the inner tube are threaded.

3. The smoking apparatus of claim 1, wherein the inner tube is removable and resides partially in the bowl piece.

4. The smoking apparatus of claim 2, wherein the mouthpiece screws onto the inner tube to secure the mouthpiece and the bowl piece.

5. The smoking apparatus of claim 1, wherein the bowl piece is in connection with the inner tube and the mouthpiece when the bowl piece and the mouthpiece are secured to each other.

6. The smoking apparatus of claim 1, wherein the used smoking materials are ejected from the smoking apparatus by pushing the inner tube into the bowl piece when the bowl piece has been moved away from the mouthpiece.

7. The smoking apparatus of claim 1, wherein the smoking apparatus is open when the mouthpiece is rotated counter-clockwise, and the smoking apparatus is closed when the mouthpiece is rotated clockwise.

8. The smoking apparatus of claim 1, wherein the smoking apparatus is made of wood.

9. The smoking apparatus of claim 1, wherein the inner tube is made of metal.

10. A method of ejecting used smoking materials out of a smoking apparatus comprising a bowl piece, mouthpiece, an inner tube comprising screw threads configured to be screwed into cooperating threads of the mouthpiece, and ejection mechanism, the method comprising:

rotating the mouthpiece to allow the screw threads of the inner tube, which connects the mouthpiece and the bowl piece, to move the bowl piece away from the mouthpiece; and activating the ejection mechanism, when the bowl piece has moved away from the mouthpiece, to force the used smoking materials out of the smoking apparatus;

wherein the used smoking material is forced out of the smoking apparatus by pushing the inner tube into the bowl piece.

11. The method of claim 10, wherein the smoking apparatus permits pushing the inner tube into the bowl piece when the bowl piece has been moved away from the mouthpiece.

12. An apparatus comprising:

a mouthpiece;

a bowl piece; and an inner tube, connecting the mouthpiece and the bowl piece, wherein the inner tube comprises screw threads configured to be screwed into cooperating threads of the mouthpiece;

wherein the apparatus comprises an ejection mechanism to eject used materials, and wherein the ejection mechanism is activated when the mouthpiece is rotated allowing the screw threads of the inner tube to move the bowl piece away from the mouthpiece.

13. The apparatus of claim 12, wherein the used materials are ejected from the apparatus by pushing the inner tube into the bowl piece when the bowl piece has been moved away from the mouthpiece.

14. The apparatus of claim 12 , wherein the mouthpiece screws onto the inner tube to secure the mouthpiece and the bowl piece, and the apparatus is open when the mouthpiece is rotated counter-clockwise, and the apparatus is closed when the mouthpiece is rotated clockwise.

15. The apparatus of claim 12, wherein the mouthpiece and the inner tube are threaded, and the inner tube is removable and resides partially in the bowl piece.

16. The apparatus of claim 12, wherein the bowl piece is in connection with the inner tube and the mouthpiece when the inner tube is screwed into the mouthpiece and the bowl piece meets the mouthpiece.

* * * * *